US007814664B2

(12) United States Patent
LeBlanc et al.

(10) Patent No.: US 7,814,664 B2
(45) Date of Patent: Oct. 19, 2010

(54) FOLDING UTILITY KNIFE

(75) Inventors: Norman LeBlanc, Davidson, NC (US); Steven R. Levine, Mooresville, NC (US); Christian S. Leyden, Concord, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 481 days.

(21) Appl. No.: 11/804,834

(22) Filed: May 21, 2007

(65) Prior Publication Data

US 2008/0289191 A1 Nov. 27, 2008

(51) Int. Cl.
*B26B 1/02* (2006.01)

(52) U.S. Cl. ..... 30/161; 30/156; 30/330

(58) Field of Classification Search ..... 30/155, 30/156, 157, 161, 329, 330, 331, 339
See application file for complete search history.

(56) References Cited

U.S. PATENT DOCUMENTS

| | | | | |
|---|---|---|---|---|
| 2,605,545 | A | 8/1952 | Weems | |
| 2,914,850 | A | 12/1959 | Kuhnl | |
| 2,980,996 | A | 4/1961 | Beran | |
| 3,577,637 | A | 5/1971 | Braginetz | |
| 4,292,738 | A | 10/1981 | Osada | |
| 4,524,518 | A | 6/1985 | West | |
| 4,604,805 | A | 8/1986 | Krieger | |
| 4,761,882 | A | 8/1988 | Silverstein | |
| 4,890,387 | A | 1/1990 | Canino | |
| 5,022,156 | A | 6/1991 | Kallens | |
| 5,095,624 | A * | 3/1992 | Ennis | 30/161 |
| 5,301,428 | A | 4/1994 | Wilcox | |
| 5,406,707 | A | 4/1995 | Owens | |
| 5,603,162 | A | 2/1997 | Chen | |
| 5,644,843 | A | 7/1997 | Young | |
| D386,381 | S | 11/1997 | Black | |
| 5,769,094 | A | 6/1998 | Jenkins, Jr. et al. | |
| 5,781,998 | A | 7/1998 | Stamper | |

(Continued)

OTHER PUBLICATIONS

International Search Report and Written Opinion of the International Searching Authority for International Application No. PCT/US2008/64375.

*Primary Examiner*—Hwei-siu C Payer
(74) *Attorney, Agent, or Firm*—McCarter & English LLP

(57) ABSTRACT

A folding utility knife has a handle and a blade holder pivotally mounted on he handle. The blade holder is movable between (i) a closed position with the blade holder pivoted inwardly toward the handle, (ii) a cutting position with the blade holder pivoted outwardly relative to the handle, and (iii) a blade release position located between the closed position and the cutting position. A blade release actuator is located on the blade holder and is movable between (i) a first position preventing release of a utility knife blade located on the blade holder, and (ii) a second position permitting release of a utility knife blade located on the blade holder. A locking member is movable between (i) a blade locking position with the blade holder located in the cutting position that prevents movement of the blade release actuator from the first position to the second position, and (ii) a blade release position with the blade holder located in the blade release position that permits movement of the blade release actuator from the first position to the second position to, in turn, release a utility knife blade from the blade holder.

21 Claims, 13 Drawing Sheets

U.S. PATENT DOCUMENTS 5,813,121 A 9/1998 Gringer
5,864,952 A 2/1999 Chung
5,906,050 A 5/1999 Gilberg
5,909,930 A 6/1999 Ragland
5,950,311 A 9/1999 Huang
5,987,751 A 11/1999 Chung
6,014,787 A 1/2000 Rivera
6,131,292 A 10/2000 Reddig
6,163,963 A 12/2000 Huang
6,192,589 B1 2/2001 Martone
6,216,301 B1 4/2001 Rivera
6,243,953 B1 6/2001 Huang
6,249,975 B1 6/2001 Lin
6,263,581 B1 7/2001 Forte
6,317,985 B1 11/2001 Huang
6,324,763 B1 12/2001 Lee
6,330,749 B1 12/2001 Khachatoorian
6,354,007 B1 3/2002 Scarla
6,357,120 B1 3/2002 Khachatoorian
6,415,514 B1 7/2002 Chun
D462,250 S 9/2002 Ping
6,446,340 B1 9/2002 Ping
6,510,767 B1 1/2003 Rivera
6,513,246 B2 2/2003 Ping
6,553,674 B1 4/2003 Budrow
6,574,868 B1 6/2003 Overholt
6,588,040 B2 7/2003 Rivera
6,622,327 B1 9/2003 Rivera
6,622,328 B2 9/2003 Rivera
6,688,003 B2 2/2004 Scarla
D495,939 S 9/2004 Ping
D497,094 S 10/2004 Rivera
6,802,094 B2 10/2004 Seber
D501,782 S 2/2005 Ping
6,857,154 B2 2/2005 Rivera
6,915,577 B2 * 7/2005 Scala ..... 30/156
6,951,055 B1 10/2005 Collins
6,957,466 B2 10/2005 Rivera
6,968,622 B2 11/2005 Ping
6,990,702 B2 1/2006 Rivera
7,003,833 B2 2/2006 Feliciano
7,007,392 B2 3/2006 Ping
7,020,922 B2 4/2006 Rivera
7,040,022 B2 5/2006 Ping
7,051,627 B2 5/2006 Rivera
7,080,423 B2 7/2006 Seber
7,134,207 B2 11/2006 Ping
7,146,668 B2 12/2006 Rivera
D535,171 S * 1/2007 Ping ..... D8/99
7,182,001 B2 2/2007 Rivera
D538,138 S 3/2007 Knight
7,185,569 B2 3/2007 Knight
D543,432 S 5/2007 Rivera
7,213,283 B2 5/2007 Rivera
7,249,390 B2 7/2007 Yale
7,296,354 B2 11/2007 Van Deursen
7,337,486 B2 3/2008 Tsuda
7,337,546 B2 * 3/2008 Cheng ..... 30/156
7,347,128 B2 3/2008 Rivera
D568,136 S * 5/2008 Ping ..... D8/99
2002/0029480 A1 3/2002 Lin
2003/0024124 A1 2/2003 Tseng
2004/0103541 A1 6/2004 Scarla
2004/0107580 A1 6/2004 Ping
2004/0112185 A1 6/2004 Ping
2005/0055833 A1 3/2005 Scarla
2005/0204567 A1 9/2005 Ping
2005/0274024 A1 12/2005 Jinliang
2005/0278955 A1 12/2005 Lee
2006/0026844 A1 2/2006 Ping
2006/0207112 A1 9/2006 Dunn et al.
2007/0006466 A1 1/2007 Ping
2007/0107232 A1 5/2007 Green
2007/0130777 A1 6/2007 Ping
2007/0294895 A1 * 12/2007 Ping ..... 30/156
2008/0086894 A1 * 4/2008 Sullivan ..... 30/155

* cited by examiner

FOLDING UTILITY KNIFE

FIELD OF THE INVENTION

The present invention relates to utility knives, and more particularly, to folding utility knives.

BACKGROUND INFORMATION

Folding utility knives typically include a handle and a blade holder pivotally mounted to the handle. The blade holder holds a utility knife blade, such as a trapezoidal utility knife blade. Part of the utility knife blade is enclosed within the blade holder, and another part of the blade extends outwardly of the blade holder with the cutting edge exposed for use. The blade holder typically includes a mechanism for securing the blade to the blade holder, such as a fastener or other type of blade securing and releasing mechanism. The blade holder is movable between a closed position pivoted inwardly toward the handle with the exposed cutting edge of the blade received within the handle, and an open position pivoted outwardly away from the handle with the cutting edge of the blade exposed for use. The blade is removed and either flipped to expose a fresh cutting edge portion of the blade for use, or is replaced with another blade, when the blade holder is in the open or operational position. One drawback of such prior art utility knives is that the blade is allowed to be removed from the blade holder when in the operational position, and as a result, the blade can become accidentally removed or dislodged during use. Another drawback of some prior art folding utility knives is that the blade release mechanisms require tools, or otherwise are not convenient to use.

Accordingly, it is an object of the present invention to overcome one or more of the above described drawbacks and/or disadvantages of the prior art.

SUMMARY OF THE INVENTION

In accordance with one aspect, the present invention is directed to a folding utility knife comprising a handle and a blade holder pivotally mounted on the handle. The blade holder is movable between (i) a closed position with the blade holder pivoted inwardly toward the handle, (ii) a cutting position with the blade holder pivoted outwardly relative to the handle, and (iii) a blade release position located between the closed position and the cutting position. The folding utility knife further comprises a blade release actuator located on the blade holder and movable between (i) a first position preventing release of a utility knife blade located on the blade holder, and (ii) a second position permitting release of a utility knife blade located on the blade holder. A locking member of the utility knife is movable between (i) a blade locking position with the blade holder located in the cutting position that prevents movement of the blade release actuator from the first position to the second position, and (ii) a blade release position with the blade holder located in the blade release position that permits movement of the blade release actuator from the first position to the second position to, in turn, release a utility knife blade from the blade holder.

In one embodiment of the present invention, the blade holder includes a blade support surface for receiving thereon a utility knife blade, and the blade release actuator includes a blade engaging portion movable with the blade release actuator between the first and second positions. The blade engaging portion engages the utility knife blade in the first position to prevent release of the utility knife blade from the blade holder, and disengages the utility knife blade in the second position to release the utility knife blade from the blade holder. Preferably, the folding utility knife further comprises a first biasing member biasing the blade release actuator in a direction from the first position toward the second position. In one embodiment of the present invention, the first biasing member is a spring, such as a coil spring. In one embodiment of the present invention, the blade release actuator includes a manually engageable portion, and the blade engaging portion extends laterally outwardly relative to the manually engageable portion. In one such embodiment, the manually engageable portion is defined by a button located on an upper side portion of the blade holder.

In one embodiment of the present invention, the folding utility knife further comprises a stop surface that contacts the locking member with the blade holder located in the cutting position, and stops movement of the locking member in a direction from the blade locking position to the blade release position. In one such embodiment, the stop surface is curvilinear. In one such embodiment, the stop surface defines a recess for receiving therein the locking member with the blade holder located in the blade release position to, in turn, permit the locking member to move from the blade locking position to the blade release position, and thereby release a utility knife blade located on the blade holder. The folding utility knife preferably further comprises a second biasing member that biases the locking member in a direction from the blade locking position toward the blade release position. In one embodiment of the present invention, the second biasing member is a spring, such as a coil spring.

Preferably, the utility knife blade defines a cutting edge including a first portion enclosed within the blade holder, and second portion extending outwardly of the blade holder and providing an exposed cutting edge for use. In one embodiment of the present invention, the blade holder defines a recess aligned with the cutting edge of the blade and exposing within the recess a segment of the first portion of the cutting edge of the blade for cutting objects, such as wires or like work pieces. In one such embodiment, the recess is inclined toward a free end of the blade holder.

In one embodiment of the present invention, the blade holder defines an upper surface, and a flat extending laterally outwardly on opposite sides of the blade holder relative to each other.

In one embodiment of the present invention, the folding utility knife comprises a release prevention device located on the blade holder that exerts a force against the utility knife blade to prevent the utility knife blade from slipping out of the blade holder when the blade engaging portion of the blade release actuator is moved to the second position. The release prevention device may be a magnet that exerts a magnetic force on the utility knife blade, or a biasing member that exerts a frictional force on the utility knife blade.

In one embodiment of the present invention, the folding utility knife comprises a protrusion located proximate to the manually engageable portion and extending from the blade holder to prevent the manually engageable portion from being inadvertently engaged by a user. In yet another embodiment, the folding utility knife comprises a tool pivotally mounted on the handle and located on an opposite end of the handle relative to the blade holder.

In accordance with another aspect, the present invention is directed to a folding utility knife comprising a handle and a blade holder pivotally mounted on the handle. The handle includes a front end having the blade holder pivotally mounted thereto, a back end located on an opposite end of the handle relative to the front end, and an upper surface extending between the back and front ends of the handle. The upper surface includes a first upper surface portion extending between the back end and an intermediate portion of the handle, and a second upper surface portion extending between the intermediate portion and the front end of the handle. The second upper surface portion is inclined downwardly at an acute angle relative to the first upper surface portion. In one embodiment, the first upper surface portion is longer than the second upper surface portion. In addition, the second upper surface portion is substantially co-planar with the upper surface of the blade holder when located in the cutting position. In another embodiment, the acute angle is within the range of about 15 degrees to about 35 degrees. In yet another embodiment, the acute angle is about 25 degrees. In a further embodiment, the handle defines a lower surface located on an approximately opposite side of the handle relative to the upper surface, and the lower surface defines a finger recess located on an opposite side of the handle relative to the second upper surface portion.

In one embodiment of the present invention, the folding utility knife comprises a manually engageable lever movable between a (i) first position engaging the blade holder to releasably retain the blade holder in the closed position, the cutting position, and/or the blade release position, and (ii) a second position disengaged from the blade holder to move the blade holder from one or more of such positions to another. The lever extends along, and defines at least in part both the first and second upper surface portions of the handle.

In accordance with another aspect, the present invention is directed to a folding utility knife comprising a handle including a manually engageable portion for gripping the handle. The folding utility knife further comprises first means for holding a utility knife blade and for pivotal movement between (i) a closed position with the first means pivoted inwardly toward the handle, (ii) a cutting position with the first means pivoted outwardly relative to the handle, and (iii) a blade release position located between the closed position and the cutting position. The folding utility knife further comprises second means located on the first means and movable between (i) a first position for preventing release of a utility knife blade located on the first means, and (ii) a second position for permitting release of a utility knife blade located on the first means. The folding utility knife further comprises third means movable between (i) a blade locking position with the first means located in the cutting position for preventing movement of the second means from the first position to the second position, and (ii) a blade release position with the first means located in the blade release position for permitting movement of the second means from the first position to the second position to, in turn, release a utility knife blade from the first means. In one embodiment of the present invention, the first means is a blade holder, the second means is a blade release actuator, and the third means is a locking member.

In accordance with another aspect, the present invention is directed to a method comprising the following steps:

(i) providing a folding utility knife including a handle, a blade holder pivotally mounted on the handle, and a utility knife blade supported on the blade holder;

(ii) pivotally moving the blade holder between (i) a closed position wherein the blade holder is pivoted inwardly toward the handle, (ii) a cutting position wherein the blade holder is pivoted outwardly relative to the handle, and (iii) a blade release position located between the closed position and the cutting position;

(iii) preventing release of the utility knife blade from the blade holder when the blade holder is located in the cutting position; and (iv) permitting release of the utility knife blade from the blade holder only when the blade holder is located in the blade release position.

In one embodiment of the present invention, the method further comprises the steps of:

(i) providing a blade release actuator on the blade holder that is movable between a first position preventing release of the utility knife blade located on the blade holder, and a second position permitting release of the utility knife blade located on the blade holder;

(ii) locking the blade release actuator in the first position when the blade holder is located in the cutting position; and (iii) unlocking the blade release actuator when the blade holder is located in the blade release position, and thereby permitting the blade release actuator to move from the first position to the second position to release the utility knife blade from the blade holder.

One advantage of the present invention is that the blade holder or like means is moved to a blade release position located between the open cutting position and the closed or folded position in order to release the utility knife blade from the blade holder. Another advantage of the present invention is that the utility knife blade is prevented from being accidentally or otherwise dislodged or removed when the blade holder or like means is located in the cutting position.

Other objects and advantages of the present invention will become readily apparent in view of the following detailed description of the currently preferred embodiments and accompanying drawings.

DETAILED DESCRIPTION OF THE CURRENTLY PREFERRED EMBODIMENTS

Figure 1:
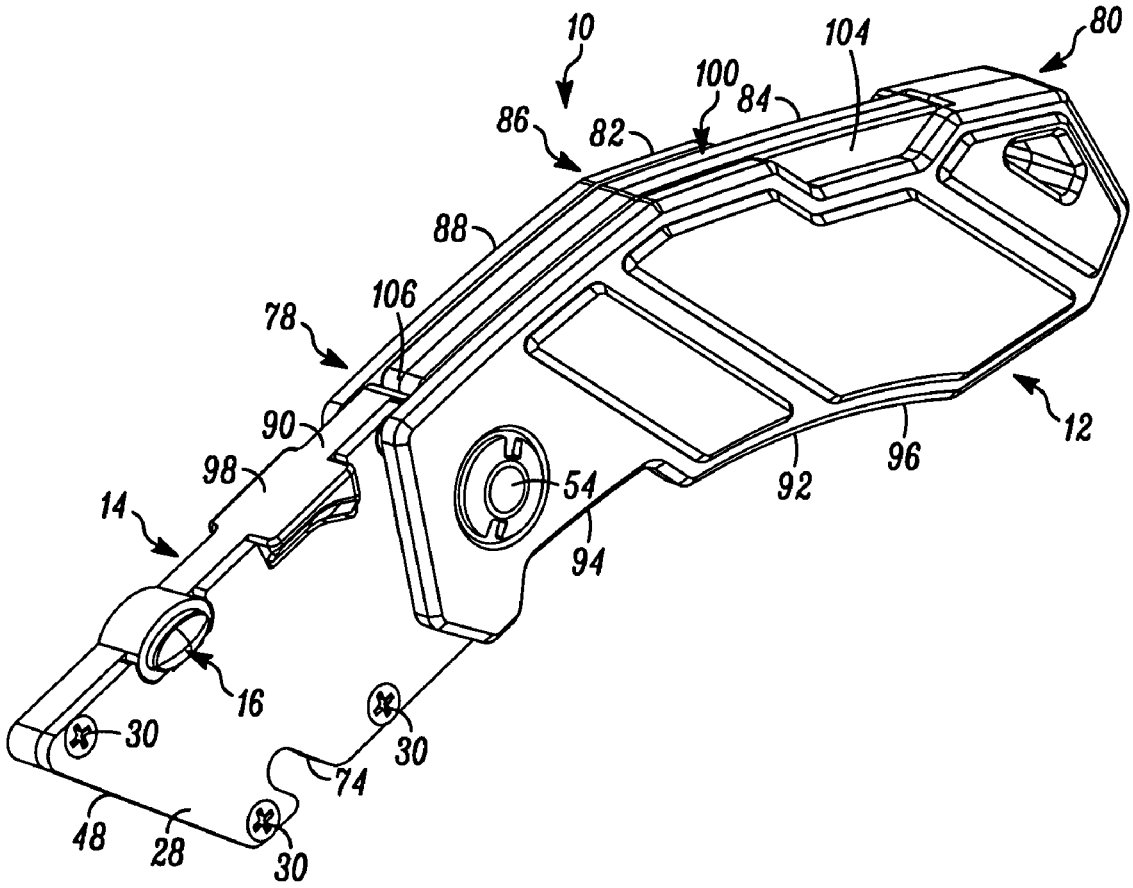
FIG. 1 is a an upper front perspective view of a folding utility knife embodying the present invention.
Figure 5:
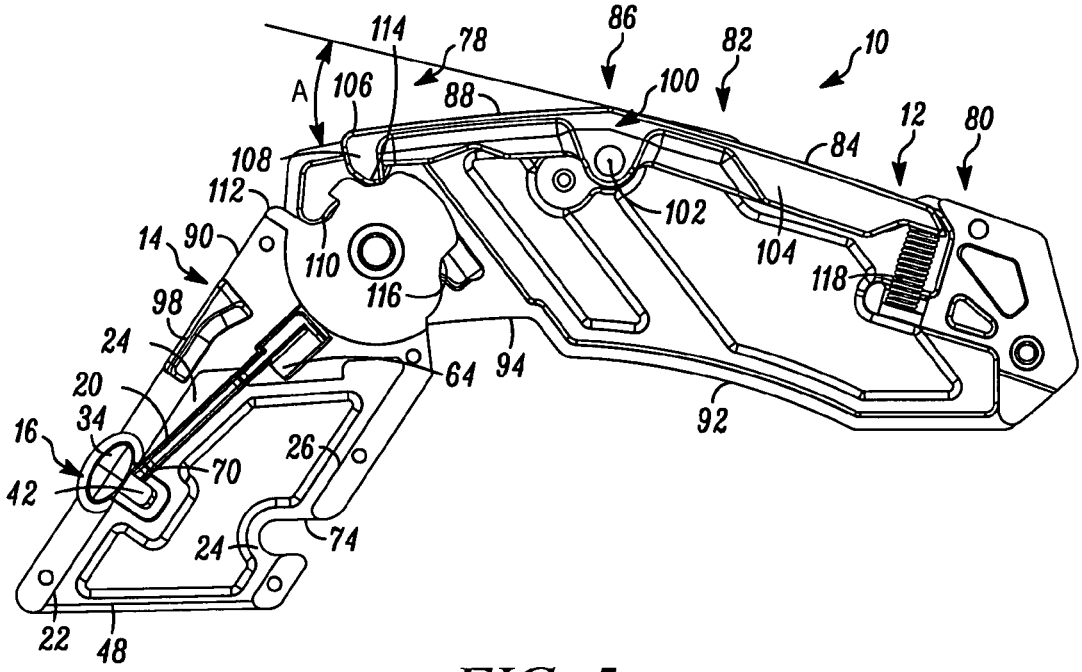
FIG. 5 is a side elevational view of the folding utility knife of FIG. 1 with the blade holder in the intermediate or blade release position and with some parts removed to show internal structure of the knife.
Figure 6:
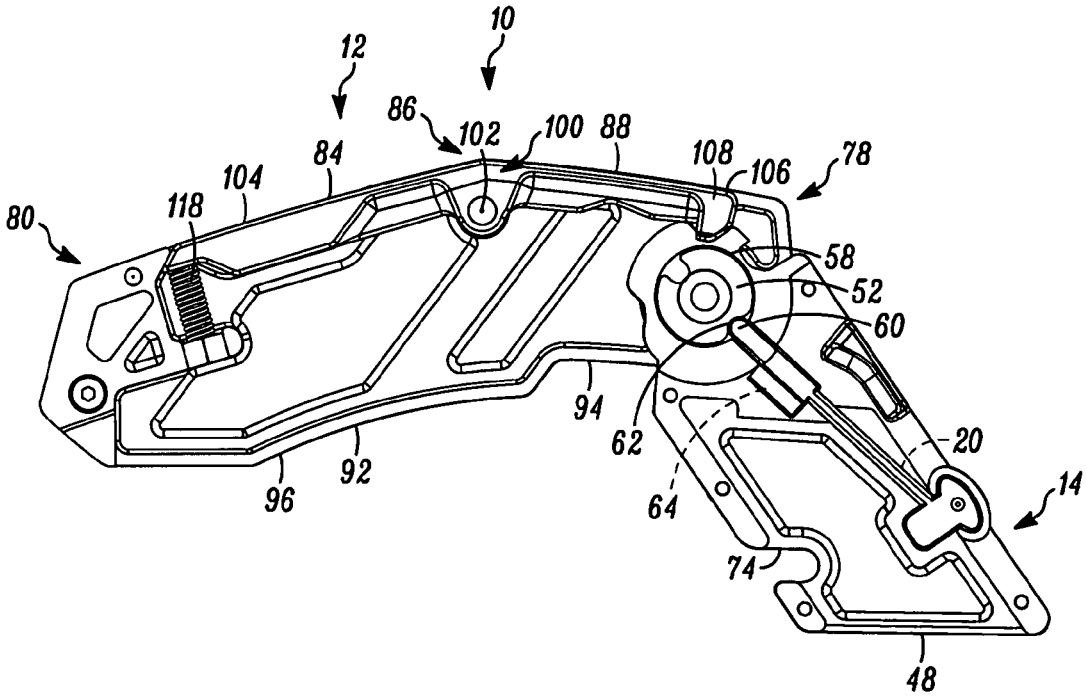
FIG. 6 is an opposite side elevational view of the folding utility knife as shown in FIG. 5 and with some parts removed to show internal structure of the knife.
Figure 7:
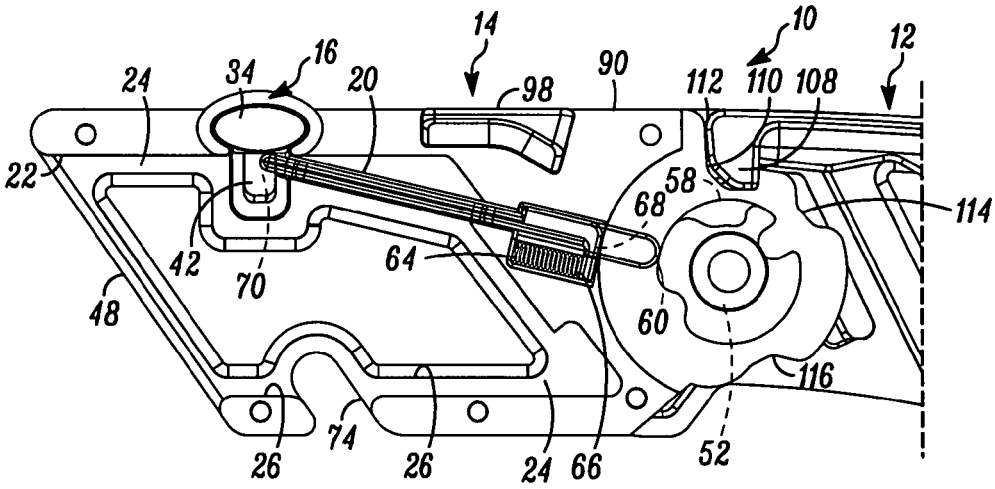
FIG. 7 is a partial, side elevational view of the folding utility knife of FIG. 1 in the cutting position and with parts removed to show internal structure.

In FIG. 1 a folding utility knife embodying the present invention is indicated generally by the reference numeral 10. The folding utility knife 10 comprises a handle 12 and a blade holder 14 pivotally mounted on the handle. The blade holder 14 is movable between (i) a closed position with the blade holder pivoted inwardly toward the handle (FIG. 4), (ii) a cutting position with the blade holder pivoted outwardly relative to the handle (FIG. 2), and (iii) a blade release position located between the closed position and the cutting position for releasing a utility knife blade from the blade holder (FIG. 3). The folding utility knife 10 further comprises a blade release actuator 16 located on the blade holder 14. As indicated by the arrow in FIG. 8, the blade release actuator 16 is movable between (i) a first position with the blade release actuator 16 extending outwardly of the blade holder 14 and preventing release of a utility knife blade 18 located on the blade holder (FIG. 8), and (ii) a second position (not shown) with the blade release actuator 16 depressed into the blade holder and permitting release of the utility knife blade 18 located on the blade holder. As shown in FIGS. 5-7, a locking member 20 is movable between (i) a blade locking position (FIG. 7) with the blade holder 14 located in the cutting position that prevents movement of the blade release actuator 16 from the first or engaged position to the second or disengaged position, and (ii) a blade release position (FIG. 5) with the blade holder 14 located in the blade release position (FIG. 3) that permits movement of the blade release actuator 16 from the first or engaged position to the second or disengaged position to, in turn, release the utility knife blade 18 from the blade holder 14.

Figure 8:
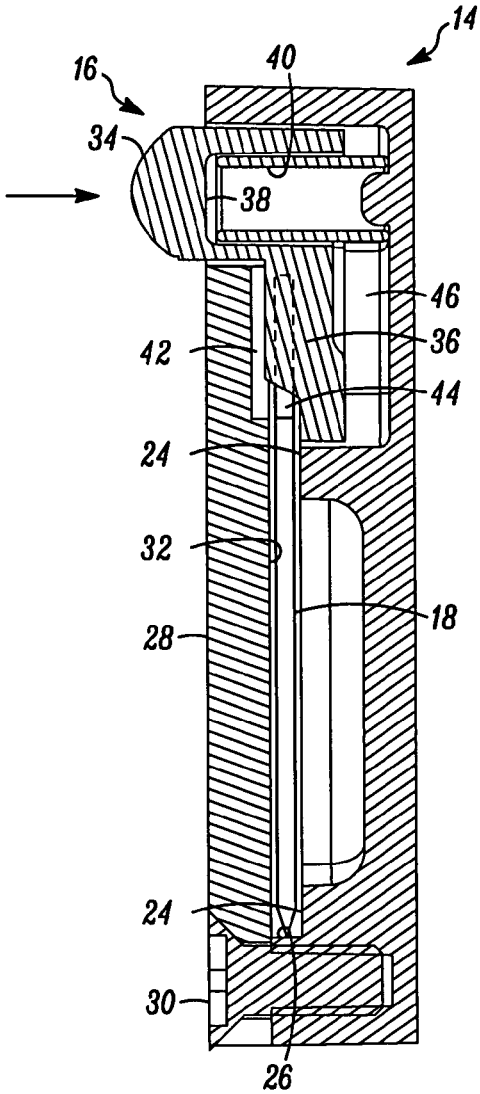
FIG. 8 is a cross-sectional view of the blade holder of the folding utility knife taken along line 8-8 of FIG. 2.

As shown in FIGS. 5-8, the blade holder 14 defines a blade receiving recess 22, a first lateral blade support surface 24 extending about the periphery of the recess 22 that engages one side of the utility knife blade 18, and a cutting edge support surface 26 extending along the base of the blade holder for supporting the cutting edge portion of a utility knife blade 18 received within the blade holder. As shown in FIGS. 1 and 8, the blade holder 14 further includes a side plate 28 fixedly secured to the blade holder over the recess 22 by a plurality of fasteners 30 and forming a second lateral blade support surface 32 on the inner side thereof. The fasteners 30 may take the form of any of numerous different fasteners that are currently known or that later become known, such as threaded fasteners or rivets. Alternatively, the side plate 28 may be fixedly secured to the blade holder by any of numerous other fastening mechanisms that are currently known, or that later become known, such as by adhesive, welding, etc. As shown in FIG. 8, the sides of the utility knife blade 18 are slidably received between, and supported by the lateral support surfaces 24, 32, and the cutting edge portion of the blade located within the blade holder 14 is supported by the cutting edge support surface 26.

As shown in FIG. 8, the blade release actuator 16 includes a manually engageable portion in the shape of a button 34, a blade engaging portion 36 extending laterally outwardly from the button 34, and a spring recess 38 located on the underside of the button for receiving a spring 40 therein. The blade engaging portion 36 includes an approximately D-shaped protrusion 42 that is received within an approximately D-shaped slot 44 formed in the utility knife blade 18 to fixedly secure the utility knife blade 18 to the blade holder 14. As can be seen, the blade engaging portion 36 engages the utility knife blade 18 in the first position to prevent release of the utility knife blade from the blade holder (i.e., the D-protrusion 42 of the blade engaging portion 36 is received within the D-slot 44 of the blade and thereby prevents the blade from moving axially within the blade holder 14). The coil spring 40 normally biases the blade release actuator 16 into the first or engaged position to thereby retain the D-protrusion 42 within the D-slot 44 of the blade. In order to disengage the blade release actuator 16, a user manually depresses the button 34 as indicated by the arrow in FIG. 8. This, in turn, moves the blade engaging portion 36 and D-protrusion 42 thereof into a receiving space 46 located to one side of the blade to thereby release the D-protrusion 42 from the D-slot 44 of the blade and allow the blade to be removed through an aperture 48 formed in the distal end of the blade holder. One advantage of the blade release actuator of the currently preferred embodiments of the present invention is that it permits release of the utility knife blade from the blade holder by simply depressing a button or like manually engageable feature when the blade holder is located in the blade release position. Accordingly, the drawbacks associated with prior art folding utility knives that require screw drivers or other tools to release the blades are obviated.

As may be recognized by those of ordinary skill in the pertinent art based on the teachings herein, the spring 40 may take any of numerous different configurations of springs or other biasing members that are currently known, or that later become known, such as different types of metal springs, such as leaf springs, or different types of plastic springs, including for example a spring that is molded integral with the blade release actuator. In addition, the utility knife blade 18 may take the form of any of numerous different types of utility knife blades that are currently known, or that later become known, such as trapezoidal utility knife blades, hooked utility knife blades, rectangular utility knife blades, snap-off utility knife blades (i.e., blades with one or more segments that can be snapped off or otherwise removed from the blade to expose a fresh cutting edge segment for use), and blades with any of numerous different configurations of cutting edges, including straight cutting edges or serrated cutting edges. In addition, the utility knife blades can include any of numerous different aperture configurations or other features for releasably retaining the utility knife blades within the blade holder, including, for example, more than one D-slot, and/or additional apertures or alternative aperture configurations located within the body of the blade. The utility knife blades likewise can be made of any of numerous different materials or material combinations, or may otherwise define any of numerous different configurations, including coating configurations, that are currently known or that later become known. Similarly, the blade release actuator may take any of numerous different configurations as needed to accommodate the many different types of utility knife blades that can be used with the folding utility knives of the present invention.

Figure 9:
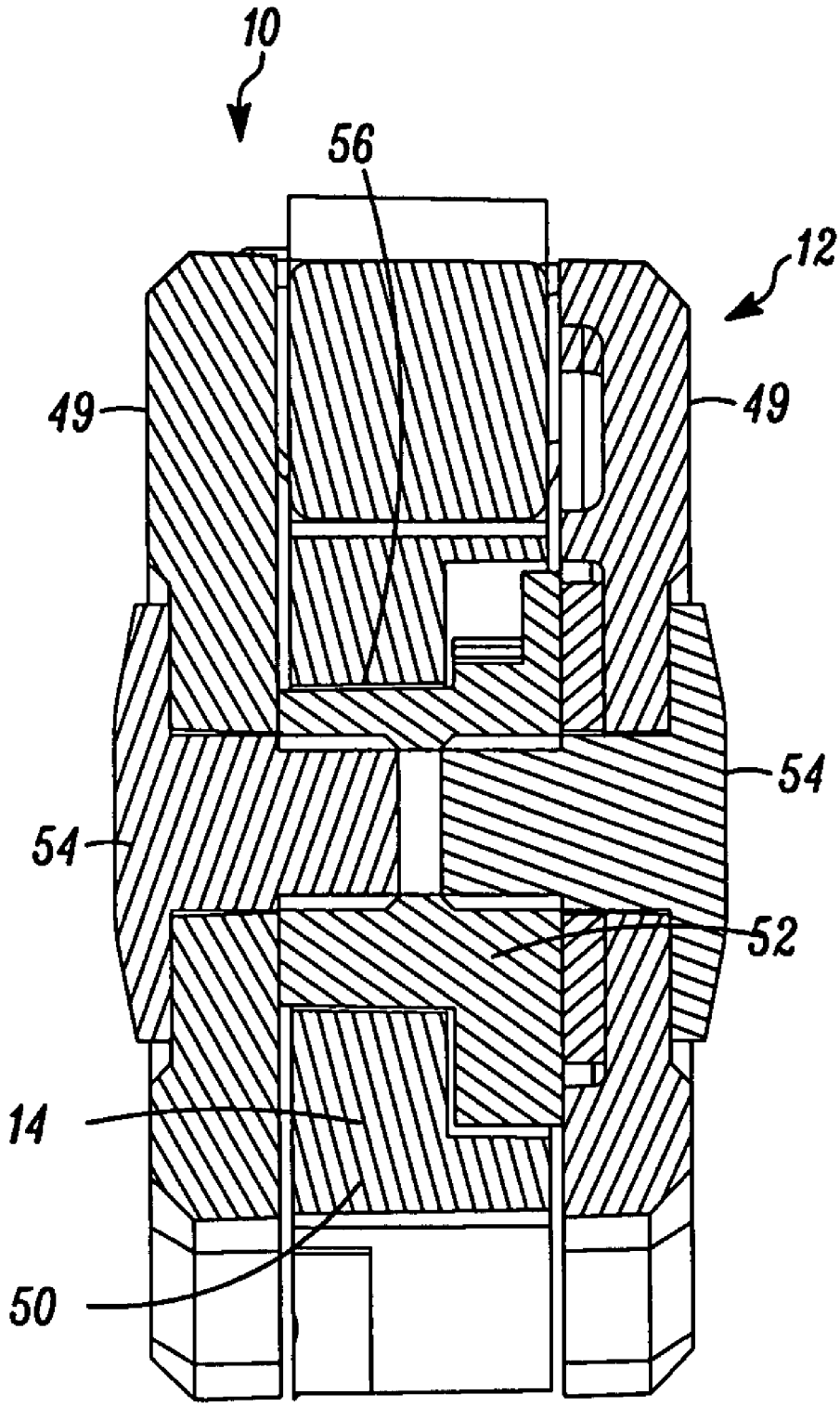
FIG. 9 is a cross-sectional view of the folding utility knife taken along line 9-9 of FIG. 2.

As shown typically in FIG. 9, the handle 12 includes opposing housing portions 49 that are laterally spaced relative to each other for receiving between the front ends thereof the pivotally mounted blade holder 14. The blade holder 14 defines a pivot aperture 50 therethrough, and a pivot spacer 52 is received within pivot aperture 50. Two fasteners 54 are threadedly received within opposing ends of the pivot spacer 52 to fixedly secure the blade holder 14 to the handle 12. As can be seen, the blade holder 14 is permitted to pivot about an external bearing surface 56 of the pivot spacer 52 to allow the blade holder to move relative to the handle between the cutting position, blade release position, and closed position. As may be recognized by those of ordinary skill in the pertinent art based on the teachings herein, the fasteners 54 may take the form of any of numerous different fasteners, and the blade holder may be pivotally mounted to the handle in any of numerous different ways, that are currently known, or that later become known.

As shown in FIG. 6, the pivot spacer 52 defines a peripheral stop surface 58 that engages the inner end 60 of the locking member 20. As shown in FIG. 7, the stop surface 58 contacts the inner end 60 of the locking member 20 when the blade holder 14 is located in the cutting position to thereby stop further movement of the locking member in a direction from the blade locking position toward the blade release position. In the illustrated embodiment, the stop surface 58 defines a circular peripheral contour such that the inner end 60 of the locking member 20 slides along the stop surface when the blade holder is pivoted between the closed, blade-release and cutting positions. As shown in FIG. 6, the stop surface 58 defines a stop recess 62 for receiving therein the inner end 60 of the locking member 20 when the blade holder 14 is located in the blade release position to, in turn, permit the locking member 20 to move from the blade locking position to the blade release position, and thereby release a utility knife blade 18 located on the blade holder 14. As shown in FIG. 7, a spring 64 is received within a recess 66 of the blade holder 14, and is connected to a depending flange 68 of the locking member 20 to normally bias the locking member in a direction from the blade locking position toward the blade release position. In the illustrated embodiment, the spring 64 is a coil spring; however, as may be recognized by those of ordinary skill in the pertinent art based on the teachings herein, the spring may take the form of any of numerous different springs, biasing members or features that are currently known, or that later become known.

In the blade locking position, and as shown typically in FIG. 7, the outer end 70 of the blade locking member 20 is received within the receiving space 46 (FIG. 8) located to one side of the blade engaging portion 36 of the blade release actuator 16 to thereby prevent the blade release actuator 16 from being moved from the first or engaged position to the second or disengaged position. Accordingly, in the blade locking position, the blade locking member 20 prevents the blade release actuator 16 from being depressed, and thus prevents removal a utility knife blade 18 from the blade holder 14. As shown typically in FIGS. 5 and 6, when the blade holder 14 is moved to the intermediate or blade release position, the inner end 60 of the blade locking member 20 is biased inwardly by the spring 64 into the stop recess 62 of the stop surface 58. As shown typically in FIG. 5, this, in turn, causes the outer end 70 of the locking member 20 to move out of the receiving space 46 located behind the blade engaging portion 36 of the blade release actuator 16, and thus permit actuation of the blade release actuator. Accordingly, in the blade release position (FIGS. 5 and 6) a user is permitted to manually depress the blade release actuator 16 against the bias of the spring 40 (FIG. 8) to release the utility knife blade 18 to remove the blade from the blade holder. When the user manually releases the blade release actuator 16, the spring 40 normally biases the blade release actuator from the second or disengaged position to the first or engaged position. The user then may flip the blade to present a fresh cutting edge for use and reinstall the blade, may install a fresh blade, or may elect to leave the blade holder empty. When installing a blade, the user depresses the blade release actuator 16 into the second position. Then, when the blade is received within the blade holder, the user releases the blade release actuator 16 and the spring 40 biases the blade release actuator to the first or engaged position to prevent removal of the blade from the blade holder. A user then may pivot the blade holder to the cutting position (FIG. 7) or to the closed position (FIG. 4). In each case, the inner end 60 of the blade locking member 20 engages the stop surface 58 when the blade holder 14 is moved out of the blade release position which, in turn, moves the outer end 70 of the blade locking member 20 into the receiving space 46 (FIG. 8) to thereby prevent movement of the blade release actuator 16 when the blade holder is not located in the blade release position.

Figure 2:
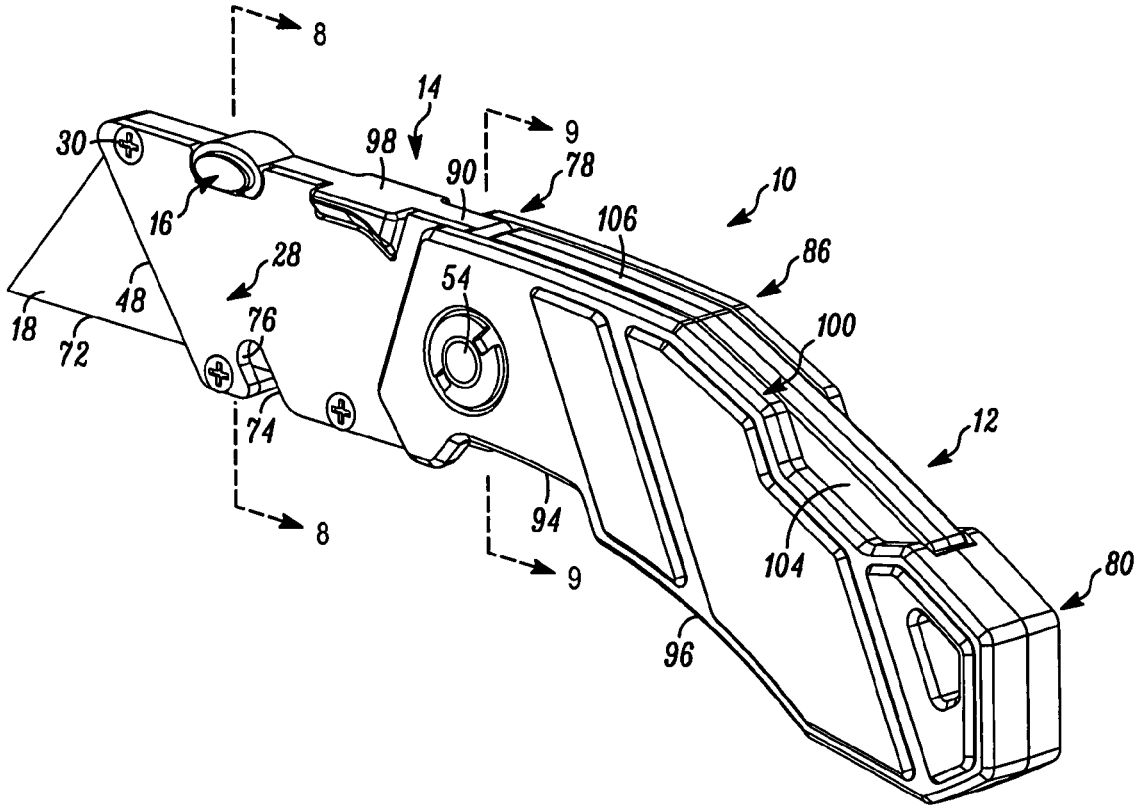
FIG. 2 is an upper rear perspective view of the folding utility knife of FIG. 1 having a trapezoidal utility knife blade seated on the blade holder and located in the open operational or cutting position.
Figure 3:
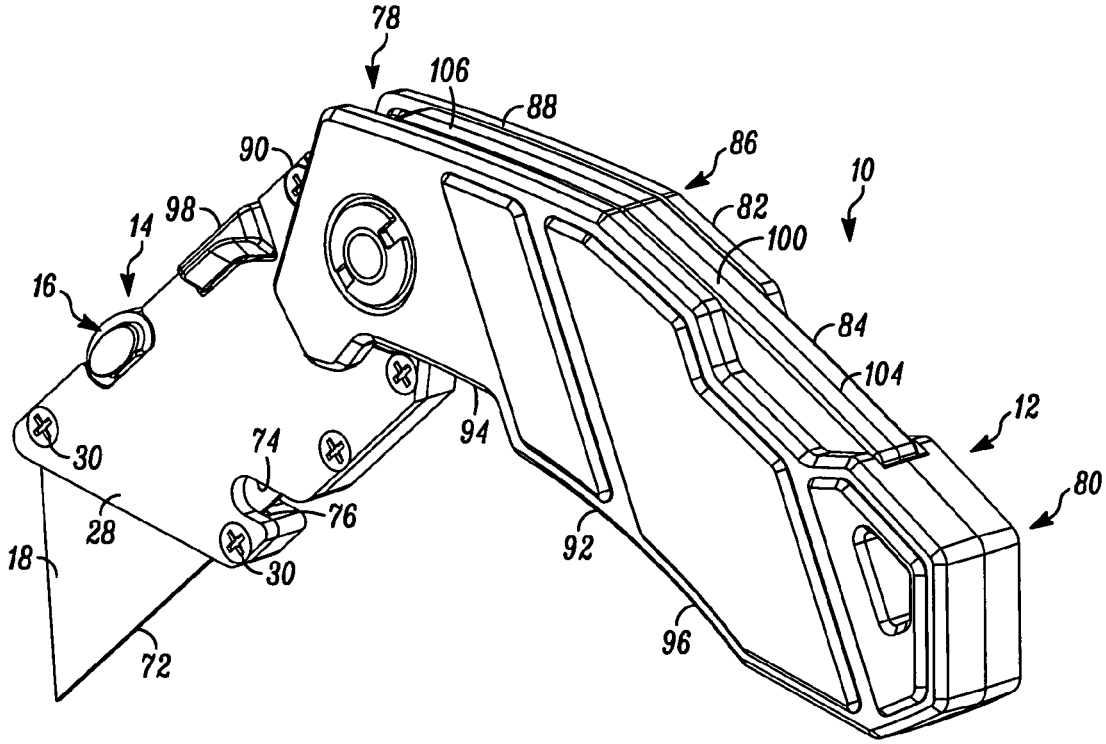
FIG. 3 is an upper rear perspective view of the folding utility knife blade of FIG. 1 with the blade holder located in the intermediate or blade release position.
Figure 4:
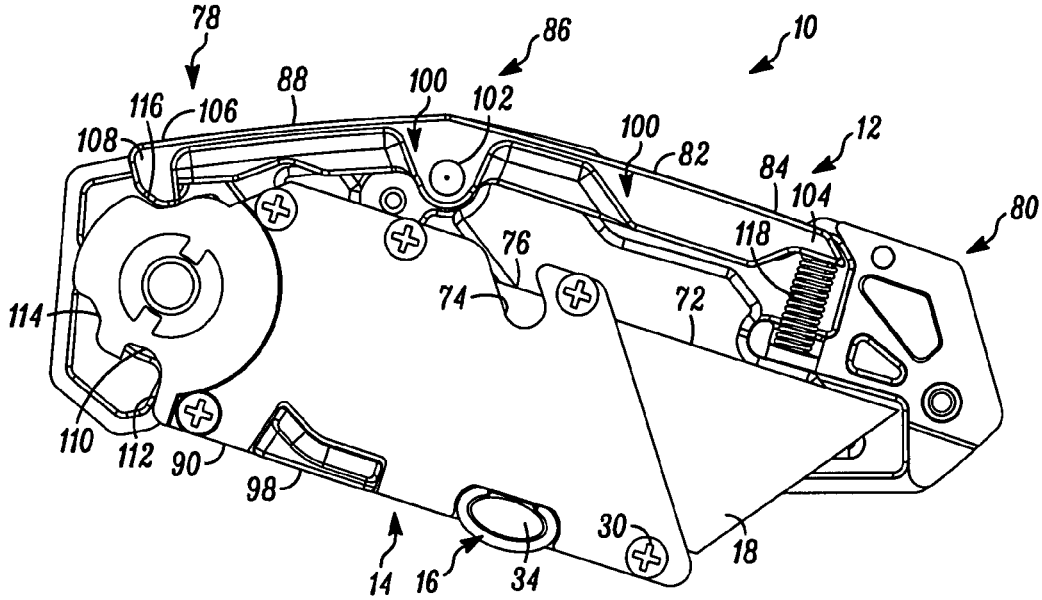
FIG. 4 is a side elevational view of the folding utility knife of FIG. 1 in the closed or folded position and with some parts removed to show internal structure of the knife.

As shown typically in FIGS. 2-4, the utility knife blade 18 defines a cutting edge 72 including a first portion enclosed within the blade holder 14, and a second portion extending outwardly of the blade holder 14 and providing an exposed cutting edge for use. The blade holder 14 defines a recess 74 aligned with the cutting edge 72 of the utility knife blade 18 and exposing within the recess a segment 76 of the first portion of the cutting edge of the blade for cutting objects, such as wires or like work pieces. In the illustrated embodiment, the recess 74 is open at the base of the blade holder, terminates in an arcuate portion, and is inclined toward a free end of the blade holder.

As shown best in FIGS. 5 and 6, the handle 12 includes a front end 78 having the blade holder 14 pivotally mounted thereto, a back end 80 located on an opposite end of the handle relative to the front end 78, and an upper surface 82 extending between the back and front ends of the handle. The upper surface 82 includes a first upper surface portion 84 extending between the back end 80 and an intermediate portion 86 of the handle, and a second upper surface portion 88 extending between the intermediate portion 86 and the front end 78 of the handle 12. The second upper surface portion 88 is inclined downwardly at an acute angle "A" relative to the first upper surface portion 84. Preferably, the angle "A" is within the range of about 15° to about 35°, and is preferably about 25°; however, as may be recognized by those of ordinary skill in the pertinent art based on the teachings herein, these angles are only exemplary and may be changed as desired or otherwise required. As can be seen, in the illustrated embodiment, the first upper surface portion 84 is longer than the second upper surface portion 88. In addition, as shown typically in FIG. 1, the second upper surface portion 88 is substantially co-planar with the upper surface 90 of the blade holder 14 when located in the cutting position. The handle 12 defines a lower surface 92 located on an approximately opposite side of the handle relative to the upper surface 82. The lower surface 92 defines an axially elongated finger recess 94 located on an opposite side of the handle 12 relative to the second upper surface portion 88, and a curvilinear portion 96 located on an opposite side of the handle relative to the first upper surface portion 84. One advantage of the illustrated handle configuration is that it facilitates gripping the handle during use by, for example, placing an index finger in the finger recess 94 and a thumb on the second upper surface portion 88, to thereby comfortably grip and safely manipulate the knife during use. The blade holder 14 further defines in its upper surface 90 a laterally expanded flat 98 located between the blade release actuator 16 and the front end 78 of the handle and extending laterally outwardly on opposite sides of the blade holder relative to each other. The expanded flat 98 can operate as a finger rest, such as for a thumb or index finger, during cutting operations.

As shown best in FIGS. 5 and 6, the folding utility knife 10 comprises a manually engageable lever 100 that is pivotable between a (i) first position engaging the blade holder 14 to releasably retain the blade holder in the closed position (FIG. 4), the cutting position (FIG. 7), and the blade release position (FIGS. 5 and 6), and (ii) a second position disengaged from the blade holder to move the blade holder from any one of such positions to another. The lever 100 is pivotally mounted by a pivot pin 102 to the intermediate portion 86 of the handle and extends along, and defines at least in part both the first and second upper surface portions 84 and 88, respectively, of the handle 12. The lever 100 includes a manually engageable end 104 located on the back end 80 of the handle 12, and a blade holder engaging end 106 located on the front end 78 of the handle. The blade holder engaging end 106 includes a depending flange 108 defining a curvilinear tip that is slidably received within corresponding recesses of the blade holder 14 to releasably retain the blade holder in each of the cutting, blade release and closed positions. With reference to FIG. 7, the blade holder 14 includes on the inner or pivot end thereof a cutting recess 110 for receiving therein the depending flange 108 of the lever 100 when located in the cutting position to releasably retain the blade holder in the cutting position. The blade holder also defines a stop surface 112 at an upper edge of the cutting recess 110 to engage the front end of the lever and prevent further outward pivotal movement of the blade holder 14 relative to the handle 12. With reference to FIG. 5, the blade holder 14 defines a blade release recess 114 angularly spaced relative to the cutting recess 110 for receiving therein the depending flange 108 of the lever 100 when the blade holder is located in the blade release position to releasably retain the blade holder in the blade release position. With reference to FIG. 4, the blade holder 14 further defines a storage or closed position recess 116 angularly spaced relative to the blade release recess 114 for receiving therein the depending flange 108 of the lever 100 when located in the closed position to releasably retain the blade holder in the closed position. A spring 118 is mounted between the manually engageable end 104 of the lever 100 and an internal surface of the handle 12, and normally biases the blade holder engaging end 106 of the lever downwardly or into the first or blade holder engaging positions. In order to pivot the blade holder 14 between the cutting, blade release and closed positions, a user manually depresses the manually engageable end 104 of the lever which, in turn, releases the depending flange 108 of the lever from one of the recesses of the blade holder 14 and allows the blade holder to be freely pivoted from one position to another. When the user manually releases the manually engageable end 104 of the lever 100, the spring 118 biases the blade holder engaging end 106 downwardly or into the first position to releasably retain the blade holder in any of the cutting, blade release and closed positions.

Figure 10:
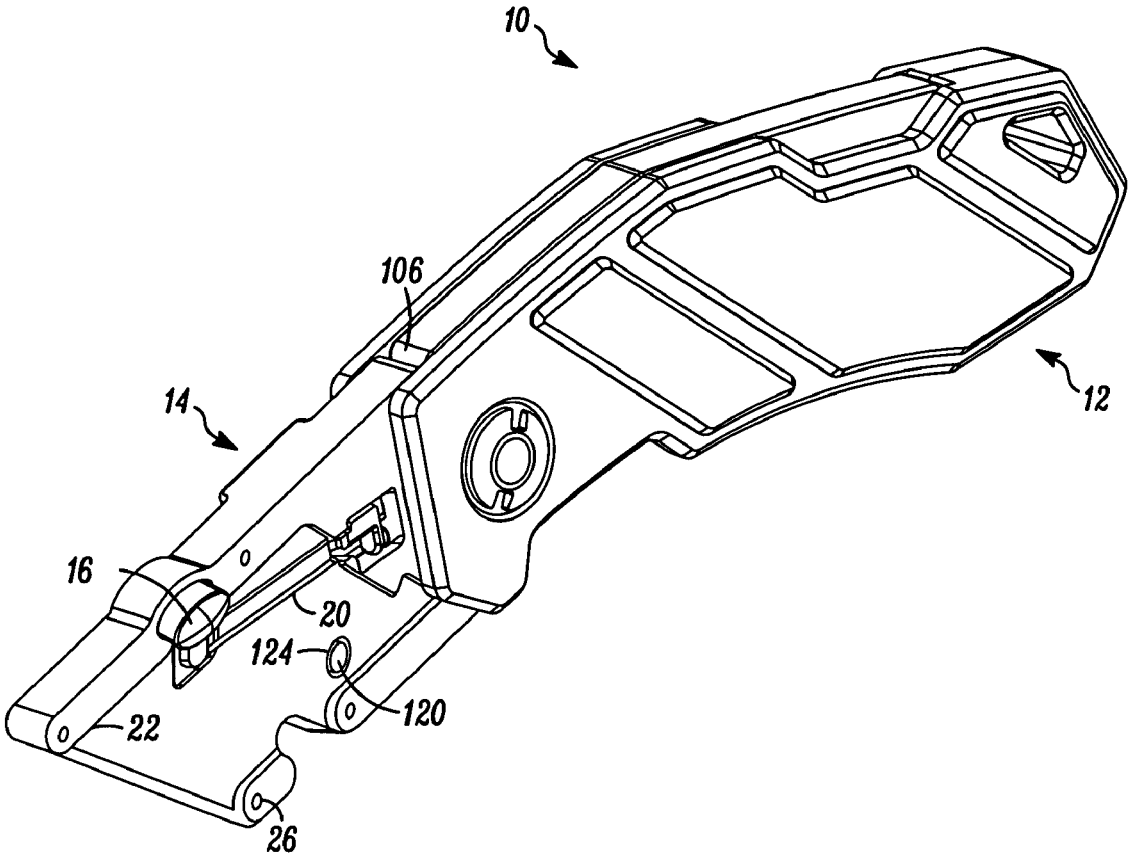
FIG. 10 is an upper front perspective view of an embodiment of the folding utility knife of FIG. 1 in the cutting position and with parts removed to show internal structure.

Another embodiment of folding utility knife 10 is shown in FIG. 10, which includes a device or mechanism incorporated into blade holder 14 to prevent a blade from falling or slipping out of blade holder 14 when blade release actuator 16 is engaged. An exemplary device, shown in FIG. 10, is magnet 120. Magnet 120 is incorporated into a side wall of blade holder 14, and exerts a magnetic force on the blade when the blade is disposed in blade holder 14. When blade release actuator 16 is depressed into blade holder 14, the blade is retained in blade holder 14 by magnet 120 until the user actively pulls the blade from blade holder 14. Magnet 120 also prevents the blade from being released should a user inadvertently engage or depress blade release actuator 16, particularly while the user is switching between the open, closed and blade release positions.

In the present embodiment, magnet 120 is shown as the device for preventing release of the blade, although other devices or mechanisms for preventing blade release may be utilized, such as a spring which biases the blade against blade holder 14 or side plate 28 and utilizes frictional forces to prevent the blade from dropping or sliding out of blade holder 14. For example, a leaf spring may be provided in place of magnet 120.

Magnet 120 may be positioned in a recess 124 in the side wall of blade holder 14, as shown in FIG. 10, so that an outer surface of magnet 120 is located flush with a surface of the side wall, or is located on or near the same plane formed by the side wall. Alternatively, the outer surface of magnet 120 may extend laterally from the side wall. In addition, magnet 120 may be located at any desired location, such as on blade receiving recess 22, first lateral blade support surface 24, cutting edge support surface 26, and side plate 28.

Figure 11:
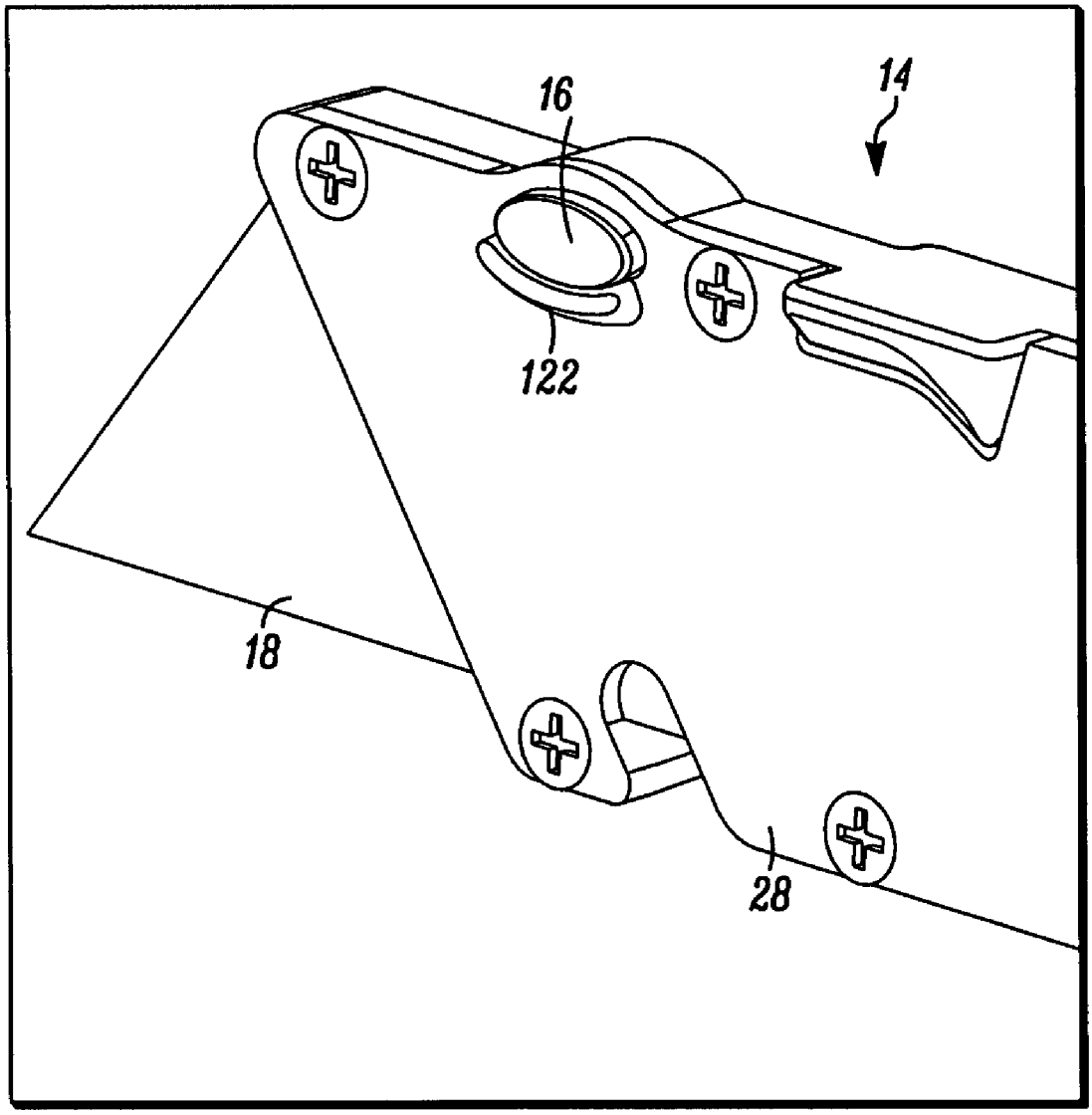
FIG. 11 is an upper rear perspective view of a portion of an embodiment of the blade holder of the folding utility knife of FIG. 1 in the cutting position.
Figure 12:
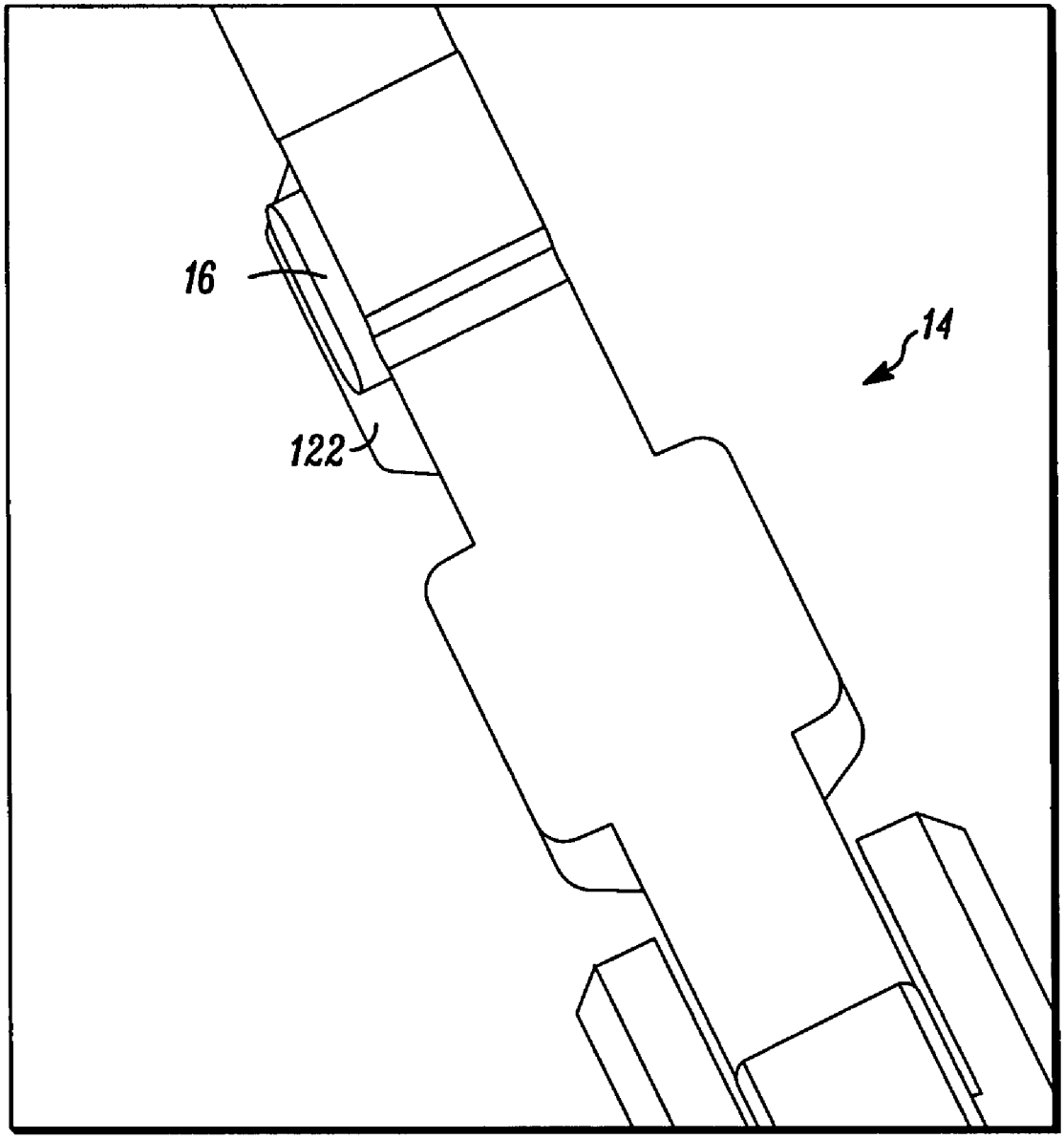
FIG. 12 is a top perspective view of the blade holder of FIG. 11.

Yet another embodiment of folding utility knife 10 is shown in FIGS. 11 and 12, and includes a device or mechanism incorporated into blade holder 14 to prevent blade release actuator 16 from being inadvertently depressed or engaged. This device or mechanism serves to prevent accidental release of a blade due to an inadvertent depression of blade release actuator 16, which can be a significant risk when switching blade holder 14 between open, closed, and blade release positions. In this embodiment, a protrusion 122, such as a brow or a ledge, extends laterally from the side of blade holder 14 and is located on the same side of blade holder 14 as release actuator 16. Should a user accidentally contact actuator 16 while holding utility knife 10 or while switching between positions, the user's thumb, finger or hand would press against protrusion 122, thereby reducing or avoiding pressure on release actuator 16 and preventing release actuator 16 from being depressed to a degree sufficient to release the blade.

Protrusion 122 preferably extends a lateral distance from blade holder 14 that is generally equal to or greater than the distance that actuator 16 extends from blade holder 14. Protrusion 122 may extend any suitable distance, as long as such length is sufficient to prevent actuator 16 from being inadvertently fully depressed and releasing the blade. In addition, although protrusion 122 is shown as being disposed along a lower portion of actuator 16, protrusion 122 may be positioned at any desired position proximate to actuator 16. Protrusion 122 may be a plurality of protrusions placed at desired locations around actuator 16, or may completely or partially surround actuator 16.

As shown in FIG. 12, protrusion 122 extends laterally from blade holder 14. Side plate 28 may include an aperture sufficient to allow both actuator 16 and protrusion 122 to extend a desired distance from side plate 28. Alternatively, protrusion 122 may extend directly from side plate 28, and may be attached to side plate 28 or formed integrally with side plate 28.

Figure 13:
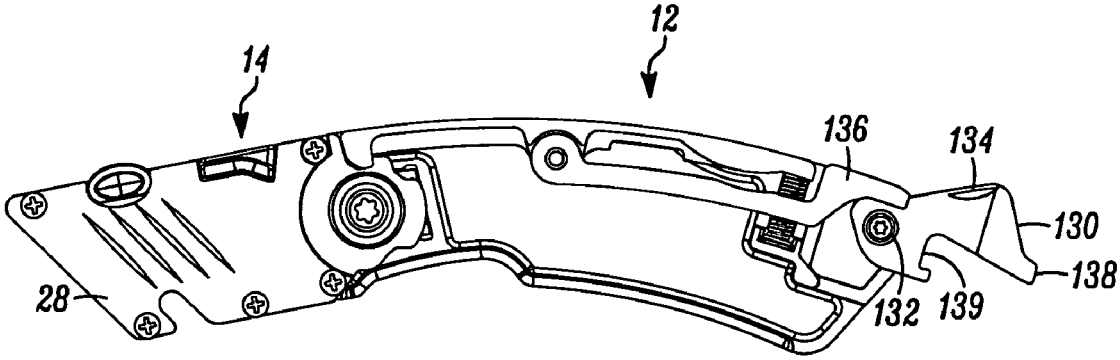
FIG. 13 is a side view of an embodiment of the folding utility knife of FIG. 1 in the cutting position and with parts removed to show internal structure, which includes a tool incorporated into the handle and in an open position.
Figure 14:
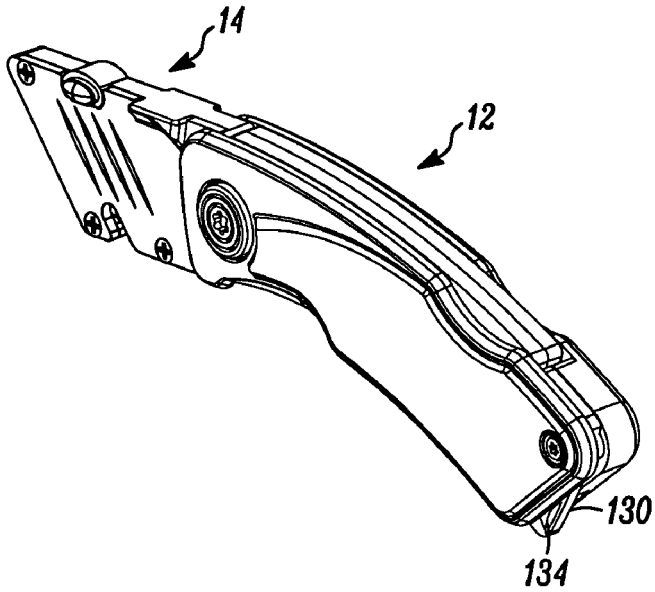
FIG. 14 is an upper rear perspective of the folding utility knife of FIG. 13, showing the tool in a closed position.

Other embodiments of folding utility knife 10, shown in FIGS. 13-20, include various tools incorporated into handle 12 on the opposite end of utility knife 10 relative to blade holder 14. FIG. 13 shows a tool 130 pivotally affixed to handle 12 in an open position, and FIG. 14 shows tool 130 in a closed position. Tool 130 is affixed to handle 12 via a pivoting hinge 132 or other connection device that allows tool 130 to be manually rotated from the open position to the closed position. A resilient member 136 is disposed within handle 12 and has an end that rests flush against an interior edge of tool 130 to bias tool 130 in either the open or closed position. If sufficient force is applied to tool 130 by the user, resilient member 136 deforms to allow tool 130 to be rotated. An example of resilient member 136 is a leaf spring, although any suitable biasing device may be utilized.

In one embodiment, tool 130 includes a groove 134 such as a nail mark, to allow a user to grasp tool 130 with a thumb or finger nail to open and close tool 130. In the embodiment shown in FIGS. 13 and 14, tool 130 includes a screwdriver 138 and a bottle opener 139. However, tool 130 may take the form of any number of tools or devices including, but not limited to, the additional exemplary tools discussed below in conjunction with FIGS. 15-20.

Figure 15:
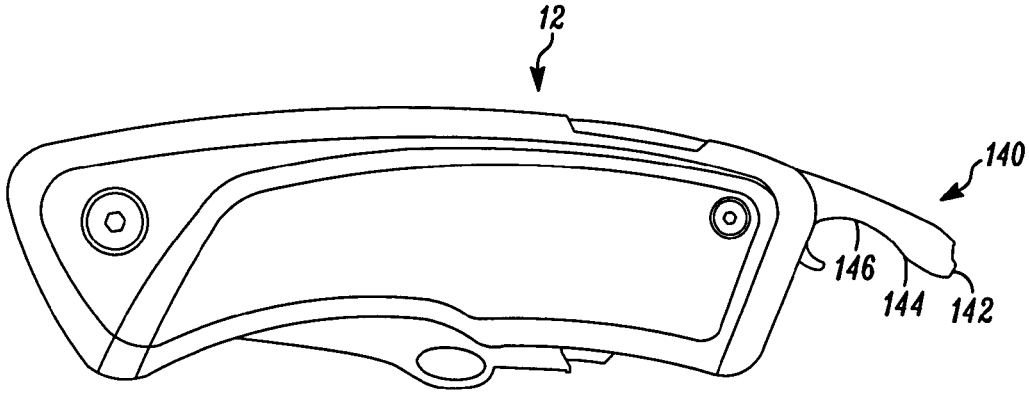
FIG. 15 is a side view of an embodiment of the folding utility knife of FIG. 1 in the closed or folded position, which includes a tool incorporated into the handle and in an open position.
Figure 16:
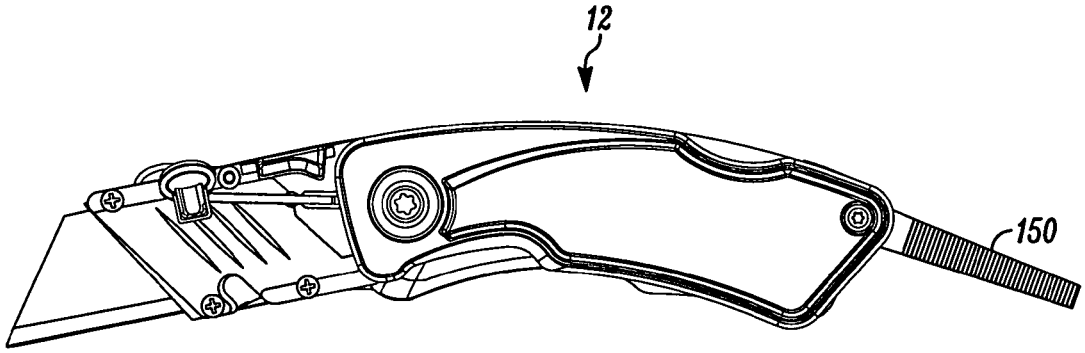
FIG. 16 is a side view of an embodiment of the folding utility knife of FIG. 1 in the cutting position, which includes a tool incorporated into the handle and in an open position.
Figure 17:
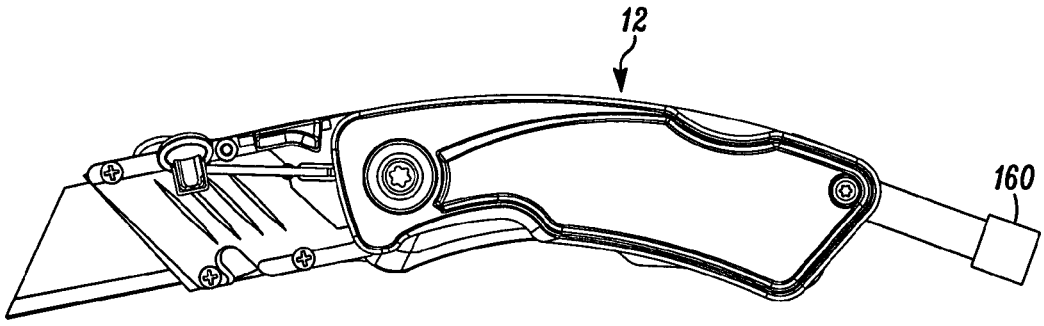
FIG. 17 is a side view of the folding utility knife of FIG. 16, including another embodiment of the tool.
Figure 18:
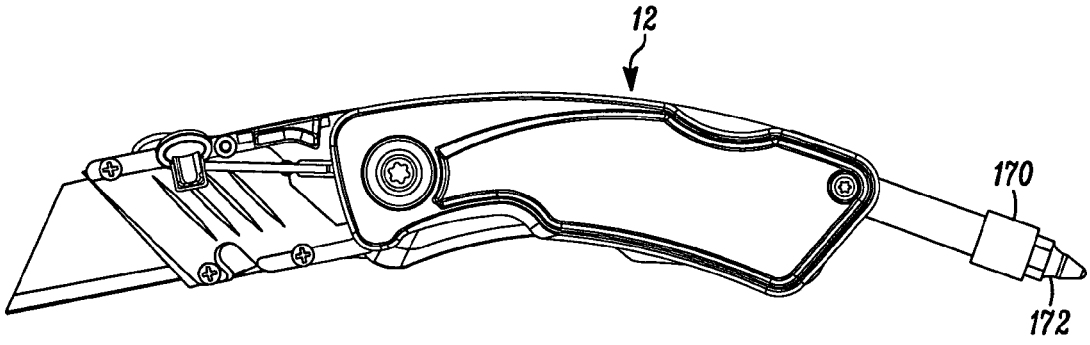
FIG. 18 is a side view of the folding utility knife of FIG. 16, including another embodiment of the tool.
Figure 19:
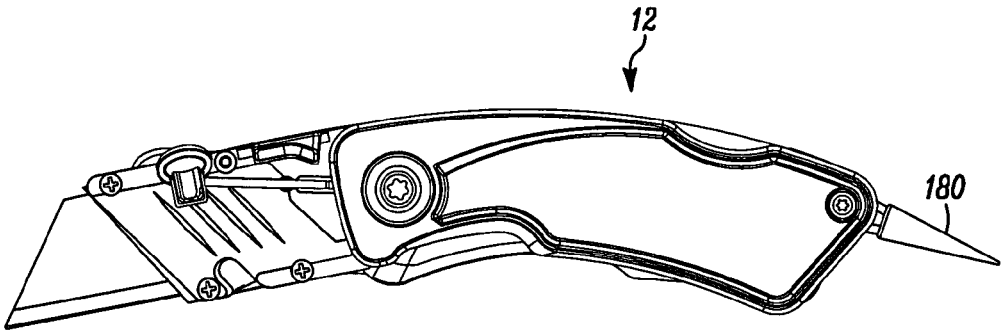
FIG. 19 is a side view of the folding utility knife of FIG. 16, including another embodiment of the tool.
Figure 20:
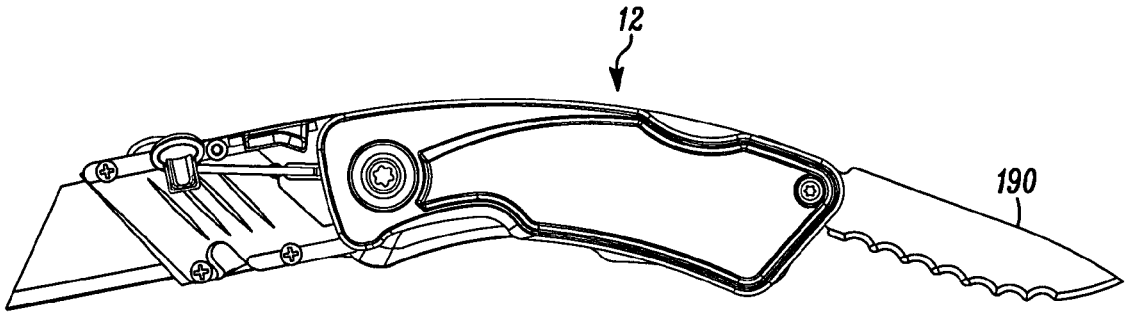
FIG. 20 is a side view of the folding utility knife of FIG. 16, including another embodiment of the tool.

Additional examples of tools that may be included in handle 12 are shown in FIGS. 15-20. FIG. 15 shows a multi-tool 140 that includes a screwdriver 142, a reamer 144, and a bottle opener 146. FIG. 16 shows a file 150. FIG. 17 shows a nut driver or socket wrench 160. FIG. 18 shows a screwdriver bit holder 170, holding a screwdriver bit 172. FIG. 19 shows a scribe, reamer, punch or awl 180. FIG. 20 shows an additional blade 190. Although blade 190 is shown as having a serrated edge, blade 190 may also have a smooth edge. Additional tools may be incorporated into handle 12, such as can openers, various pocket knife blades, a corkscrew, pliers, and flat head and phillips head screwdrivers.

As may be recognized by those of ordinary skill in the pertinent art based on the teachings herein, numerous changes and modifications may be made to the above-described and other embodiments of the present invention without departing from the scope of the invention as defined in the appended claims. For example, the components of the folding utility knife may be made of any of numerous different materials, or may take any of numerous different shapes and configurations that are currently known, or that later become known. For example, the blade release actuator may take any of numerous different shapes and/or configurations, the mechanism for pivotally mounting the blade holder to the handle may take any of numerous different configurations, the blade holder may take any of numerous different configurations, and the mechanism for releasably retaining the blade holder in the various positions and/or releasing the blade holder from one position for movement to another, may take any of numerous different configurations, that are currently known, or that later become known. In addition, the blade holder may define more than one cutting position and/or more than one blade release position. Accordingly, this detailed description of the currently preferred embodiments is to be taken in an illustrative as opposed to a limiting sense.

What is claimed is:

1. A folding utility knife, comprising:

a handle;

a blade holder pivotally mounted on the handle and movable between (i) a closed position with the blade holder pivoted inwardly toward the handle, (ii) a cutting position with the blade holder pivoted outwardly relative to the handle, and (iii) a blade release position;

a blade release actuator located on the blade holder and movable between (i) a first position preventing release of a utility knife blade located on the blade holder, and (ii) a second position permitting release of a utility knife blade located on the blade holder;

a locking member movable between (i) a blade locking position with the blade holder located in the cutting position that prevents movement of the blade release actuator from the first position to the second position, and (ii) a blade release position with the blade holder located in the blade release position that permits movement of the blade release actuator from the first position to the second position to, in turn, release a utility knife blade from the blade holder; and a stop surface that contacts the locking member with the blade holder located in the cutting position and stops movement of the locking member in a direction from the blade locking position to the blade release position, wherein the stop surface defines a recess for receiving therein the locking member with the blade holder located in the blade release position to, in turn, permit the locking member to move from the blade locking position to the blade release position and thereby release a utility knife blade located on the blade holder.

2. A folding utility knife as defined in claim 1, further comprising a biasing member biasing the locking member in a direction from the blade locking position toward the blade release position.

3. A folding utility knife as defined in claim 2, wherein the biasing member is a spring.

4. A folding utility knife comprising:

a handle;

a blade holder pivotally mounted on the handle and movable between (i) a closed position with the blade holder pivoted inwardly toward the handle, (ii) a cutting position with the blade holder pivoted outwardly relative to the handle, and (iii) a blade release position;

a blade release actuator located on the blade holder and movable between (i) a first position preventing release of a utility knife blade located on the blade holder, and (ii) a second position permitting release of a utility knife blade located on the blade holder; and a locking member movable between (i) a blade locking position with the blade holder located in the cutting position that prevents movement of the blade release actuator from the first position to the second position, and (ii) a blade release position with the blade holder located in the blade release position that permits movement of the blade release actuator from the first position to the second position to, in turn, release a utility knife blade from the blade holder, wherein the cutting position and the blade release position are different positions, and wherein the utility knife blade is releasable only when the blade holder is in the blade release position.

5. A folding utility knife as defined in claim 4, wherein the blade holder includes a blade support surface for receiving thereon the utility knife blade, and the blade release actuator includes a blade engaging portion movable with the blade release actuator between the first and second positions, wherein the blade engaging portion engages the utility knife blade in the first position to prevent release of the utility knife blade from the blade holder, and disengages the utility knife blade in the second position to release the utility knife blade from the blade holder.

6. A folding utility knife as defined in claim 5, further comprising a first biasing member biasing the blade release actuator in a direction from the first position toward the second position.

7. A folding utility knife as defined in claim 6, wherein the first biasing member is a spring.

8. A folding utility knife as defined in claim 6, wherein the blade release actuator includes a manually engageable portion, and the blade engaging portion extends laterally outwardly relative to the manually engageable portion.

9. A folding utility knife as defined in claim 8, wherein the manually engageable portion is defined by a button located on an upper side portion of the blade holder.

10. A folding utility knife as defined in claim 8, further comprising a protrusion located proximate to the manually engageable portion and extending from the blade holder to prevent the manually engageable portion from being inadvertently engaged by a user.

11. A folding utility knife as defined in claim 5, further comprising a release prevention device located on the blade holder that exerts a force against the utility knife blade to prevent the utility knife blade from slipping out of the blade holder when the blade engaging portion of the blade release actuator is moved to the second position.

12. A folding utility knife as defined in claim 11, wherein the release prevention device is selected from i) a magnet that exerts a magnetic force on the utility knife blade, and ii) a biasing member that exerts a frictional force on the utility knife blade.

13. A folding utility knife as defined in claim 4, further comprising a stop surface that contacts the locking member with the blade holder located in the cutting position and stops movement of the locking member in a direction from the blade locking position to the blade release position.

14. A folding utility knife as defined in claim 13, wherein the stop surface is curvilinear.

15. A folding utility knife as defined in claim 4, further comprising a utility knife blade received on the blade holder, wherein the utility knife blade defines a cutting edge including a first portion enclosed within the blade holder, and second portion extending outwardly of the blade holder and providing an exposed cutting edge for use.

16. A folding utility knife as defined in claim 15, wherein the blade holder defines a recess aligned with the cutting edge of the blade and exposing within the recess a segment of the first portion of the cutting edge of the blade for cutting objects therewith.

17. A folding utility knife as defined in claim 16, wherein recess is inclined toward a free end of the blade holder.

18. A folding utility knife as defined in claim 4, wherein the blade holder defines an upper surface, and a flat extending laterally outwardly on opposite sides of the blade holder relative to each other.

19. A folding utility knife as defined in claim 4, further comprising a tool pivotally mounted on the handle and located on an opposite end of the handle relative to the blade holder.

20. A folding utility knife comprising:

a handle;

first means for holding a utility knife blade and for pivotal movement between (i) a closed position with the first means pivoted inwardly toward the handle, (ii) a cutting position with the first means pivoted outwardly relative to the handle, and (iii) a blade release position located between the closed position and the cutting position;

second means located on the first means and movable between (i) a first position for preventing release of a utility knife blade located on the first means, and (ii) a second position for permitting release of a utility knife blade located on the first means; and third means movable between (i) a blade locking position with the first means located in the cutting position for preventing movement of the second means from the first position to the second position, and (ii) a blade release position with the first means located in the blade release position for permitting movement of the second means from the first position to the second position to, in turn, release a utility knife blade from the first means.

wherein the cutting position and the blade release position are different positions, and wherein the utility knife blade is releasable only when the first means is in the blade release position.

21. A folding utility knife as defined in claim 20, wherein the first means is a blade holder, the second means is a blade release actuator, and the third means is a locking member.

* * * * *